US005178112A

United States Patent [19]

Terazawa et al.

[11] Patent Number: 5,178,112

[45] Date of Patent: Jan. 12, 1993

[54] THROTTLE CONTROL APPARATUS

[75] Inventors: Tadashi Terazawa, Toyota; Tatsuo Kato, Handa; Mitsuo Kikkawa, Anjo; Shoichi Doi, Kariya, all of Japan

[73] Assignee: Aisin Seiki Kabushiki Kaisha, Kariya, Japan

[21] Appl. No.: 809,324

[22] Filed: Dec. 18, 1991

[30] Foreign Application Priority Data

Dec. 26, 1990 [JP] Japan ..... 2-416582

[51] Int. Cl.[5] ..... F02D 9/08

[52] U.S. Cl. ..... 123/399; 123/400

[58] Field of Search ..... 123/361, 399, 400

[56] References Cited

U.S. PATENT DOCUMENTS

| | | | |
|---|---|---|---|
| 4,873,957 | 10/1989 | Ueyama et al. | 123/400 X |
| 5,002,032 | 3/1991 | Kolberg | 123/399 |
| 5,016,589 | 5/1991 | Terazawa | 123/400 X |
| 5,040,508 | 8/1991 | Watanabe | 123/400 X |
| 5,046,575 | 9/1991 | Asayama | 123/399 X |
| 5,048,485 | 9/1991 | Terazawa et al. | 123/400 X |

FOREIGN PATENT DOCUMENTS

| | | | |
|---|---|---|---|
| 55-145867 | 11/1980 | Japan . | |
| 63-80039 | 4/1988 | Japan . | |
| 96435 | 4/1989 | Japan | 123/400 |

*Primary Examiner*—Willis R. Wolfe

*Attorney, Agent, or Firm*—Burns, Doane, Swecker & Mathis

[57] ABSTRACT

A throttle control apparatus includes an accelerator operation mechanism, a driving source generating driving force in response to at least an operation amount of the accelerator operation mechanism, a throttle shaft fixing a throttle valve of an internal combustion engine thereto and supported on a housing so as to be able to rotate, an electromagnetic clutch mechanism being intermittent a connection between the throttle shaft and the driving source and having a dog clutch which transmits the driving force of the driving source to the throttle shaft and a driving control device for controlling the electromagnetic clutch and the driving source and opening and closing the throttle valve. According to this constitution, when the electromagnetic clutch mechanism operates, the driving source is connected with the throttle shaft via the dog clutch and the driving force of the driving source is immediately transmitted to the throttle shaft. Therefore, it is able to obtain a good response performance and it is able to improve the durability. Furthermore, the electromagnetic clutch mechanism may be provided with an electromagnetic coil, a rotor and a movable member. In this case, when the throttle control apparatus is constituted so as to transmit the driving source via outer teeth which are connected with the driving source and which are formed on outer circumferential edge portion of the rotor and the nail portions which are formed on the rotor and the movable member adjacent to the outer teeth, the throttle control apparatus can be made lighter and smaller.

4 Claims, 6 Drawing Sheets

THROTTLE CONTROL APPARATUS

BACKGROUND OF THE INVENTION

1. Field of the Invention

The present invention relates to a throttle control apparatus installed on an internal combustion engine, and more particularly to a throttle control apparatus for controlling the opening and closing action of a throttle valve by a driving source such as a motor and so on in response to an operation of an accelerator and for being able to perform various controls such as a constant speed driving control and so on.

2. Description of the Prior Art

In an internal combustion engine which is provided with a carburetor, a throttle valve controls a mixed gas which air and fuel are mixed each other and in an internal combustion engine which is provided with an electronic controlled fuel injection apparatus, a throttle valve controls the generating power of the internal combustion engine by adjusting the intake air flow. These throttle valves are constituted so as to link with an accelerator operation mechanism including an accelerator.

In recent years, apparatuses which open and close the throttle valve by a driving source such as a motor and so on in response to an operation of an accelerator are proposed in contrast to the above prior art which the accelerator operation mechanism is mechanically connected with the throttle valve. An apparatus which drives a stepping motor connected with the throttle valve in response to an operation of an accelerator is disclosed, for example, in Japanese patent application laid-open publication No. 55(1980)-145867.

This apparatus includes an electromagnetic clutch interposed between a throttle shaft and a rotating shaft rotated by a depression of the accelerator and arranged so as to separate both shafts from each other in its exciting condition and to connect both shafts each other in its nonexciting condition and a control circuit for detecting abnormalities of operations of an electronic controlled actuator and for stopping the supply of an electric source to the electronic controlled actuator and the electromagnetic clutch by a relay. In this apparatus, the throttle shaft is mechanically connected with the accelerator via the electromagnetic clutch when the control of the electronic controlled actuator became impracticable.

Furthermore, an apparatus which overcomes a drawback of the prior apparatus disclosed in the above publication is disclosed in Japanese patent application laid-open publication No. 63(1988)-80039. In this apparatus, the accelerator operating portion and the throttle valve are connected each other when the amount of the throttle valve opening corresponded to the operational amount of the accelerator operating portion under the abnormal condition of the actuator and so on in contrast to the above prior apparatus which the amount of the throttle valve opening does not correspond to the operational amount of the accelerator operating portion when the accelerator operating portion and the throttle valve were connected each other. According to this apparatus, the electric current is not turned on an electromagnetic coil under the normal condition and is turned on the electromagnetic coil under the abnormal condition so as to connect the throttle valve and an accelerator link each other. And then the electric current which is turned on the electromagnetic coil is interrupted temporarily when the accelerator was released in the abnormal condition and thereby the connection between the accelerator link and a clutch disk is released. After the throttle valve has fully closed the electromagnetic coil is excited again and thereby the accelerator link and the clutch disk are connected each other.

In the above described prior throttle control apparatuses, however, the clutch mechanism is connected by a frictional engagement or an engagement between an engaged member (an engaged pin) and an engaged groove (an engaged hole). According to the former clutch mechanism using the frictional engagement, it is difficult to transmit the driving force and scaling up of the clutch mechanism and the apparatus is unavoidable in order to transmit the requisite driving force. On the other hand, according to the latter clutch mechanism using the engagement between the engaged member and the engaged groove, the transmitting portion of the driving force becomes point contact substantially as the apparatus disclosed in the above Japanese patent application laid-open publication No. 63(1988)-80039 and moreover fairish rotational angle is necessitated for obtaining the engagement between the engaged member and the engaged groove after a clutch plate contacted with a driven gear. Thereby, the wasteful rotation is caused in the motor as the driving source. In particular, when the stepping motor is applied in order to give the accurate rotation to the clutch plate, it is necessary to correct the rotation angle after the connection and a correction amount enlarges in case of the connection by the engagement between the engaged member and the engaged groove.

Furthermore, in the above described prior throttle control apparatuses, neither the clutch plate nor the driven gear connected therewith are hollow as disclosed in the above latter publication and it is difficult to form an opening portion in the clutch plate or the driven gear from positions of the clutch plate and the driven gear. Even if it is able to form the opening portion, since a distance between the outer tooth portion of the driven gear and the portion of the engaged member and the engaged groove which the driving force is transmitted is large, it is not able to form a very large opening portion and therefore it is not able to expect making light weight. Furthermore, the engaged member is not only necessitated but it is necessary to thicken the thickness of the clutch plate in order to form the engaged member. Therefore, it is necessary to take a special measure to miniaturize component parts.

SUMMARY OF THE INVENTION

It is, therefore, an object of the present invention to provide an improved throttle control apparatus which overcomes drawbacks of the above prior arts.

It is another object of the present invention to miniaturize a throttle control apparatus.

It is further object of the present invention to provide an improved throttle control apparatus which can make lighter and smaller component parts related to the electromagnetic clutch mechanism.

In order to achieve these objects, there is provided an improved throttle control apparatus includes an accelerator operation mechanism, a driving source generating driving force in response to at least an operational amount of the accelerator operation mechanism, a throttle shaft fixing a throttle valve of an internal combustion engine thereto and supported on a housing so as to be able to rotate, an electromagnetic clutch mechanism being intermittent a connection between the throttle shaft and the driving source and having a dog clutch which transmits the driving force of the driving source to the throttle shaft and a driving control means for controlling the electromagnetic clutch and the driving source and opening and closing the throttle valve.

Furthermore, in order to achieve these objects, there is provided an improved throttle control apparatus an accelerator operation mechanism, a driving source generating driving force in response to at least an operational amount of the accelerator operation mechanism, a throttle shaft fixing a throttle valve of an internal combustion engine thereto and supported on a housing so as to be able to rotate and having at least an one end portion which extends from the housing, a supporting member fixed to an extending portion of the throttle shaft, a rotor supported at a prescribed place on the throttle shaft between the supporting member and the throttle valve so as to be able to rotate and so as not to be able to move in the direction of an axis of the throttle shaft and having outer teeth which are formed on the whole circumference of its own outer circumferential end portion and first nail portions which are formed on an its own flat portion adjacent to the outer teeth so as to radially extend and so as to be continuously arranged on the whole circumference and connected with the driving source so as to be rotated by the driving force of the driving source, a movable member made of a magnetic substance and supported on the throttle shaft so as to be movable in the direction of the axis of the throttle shaft between the rotor and the supporting member and having second nail portions which are formed on the whole circumference of an its own flat portion opposite to the rotor so as to locate opposite to the first nail portion and so as to have a substantially same shape as the first nail portions in order to constitute a dog clutch with the rotor, a connective member connecting the movable member with the supporting member and urging the movable member toward the supporting member and an electromagnetic coil fixed to an place of the housing opposite to the rotor and attracting the movable member under its own exciting condition so as to connect the movable member with the rotor.

BRIEF DESCRIPTION OF THE DRAWINGS

Additional objects and advantages of the present invention will become more apparent from the following detailed description of preferred embodiment thereof when considered with reference to the attached drawings, in which.

DESCRIPTION OF THE PREFERRED EMBODIMENT

A throttle control apparatus which is constituted in accordance with a preferred embodiment of the present invention will be described with reference to the drawings.

Figure 1:
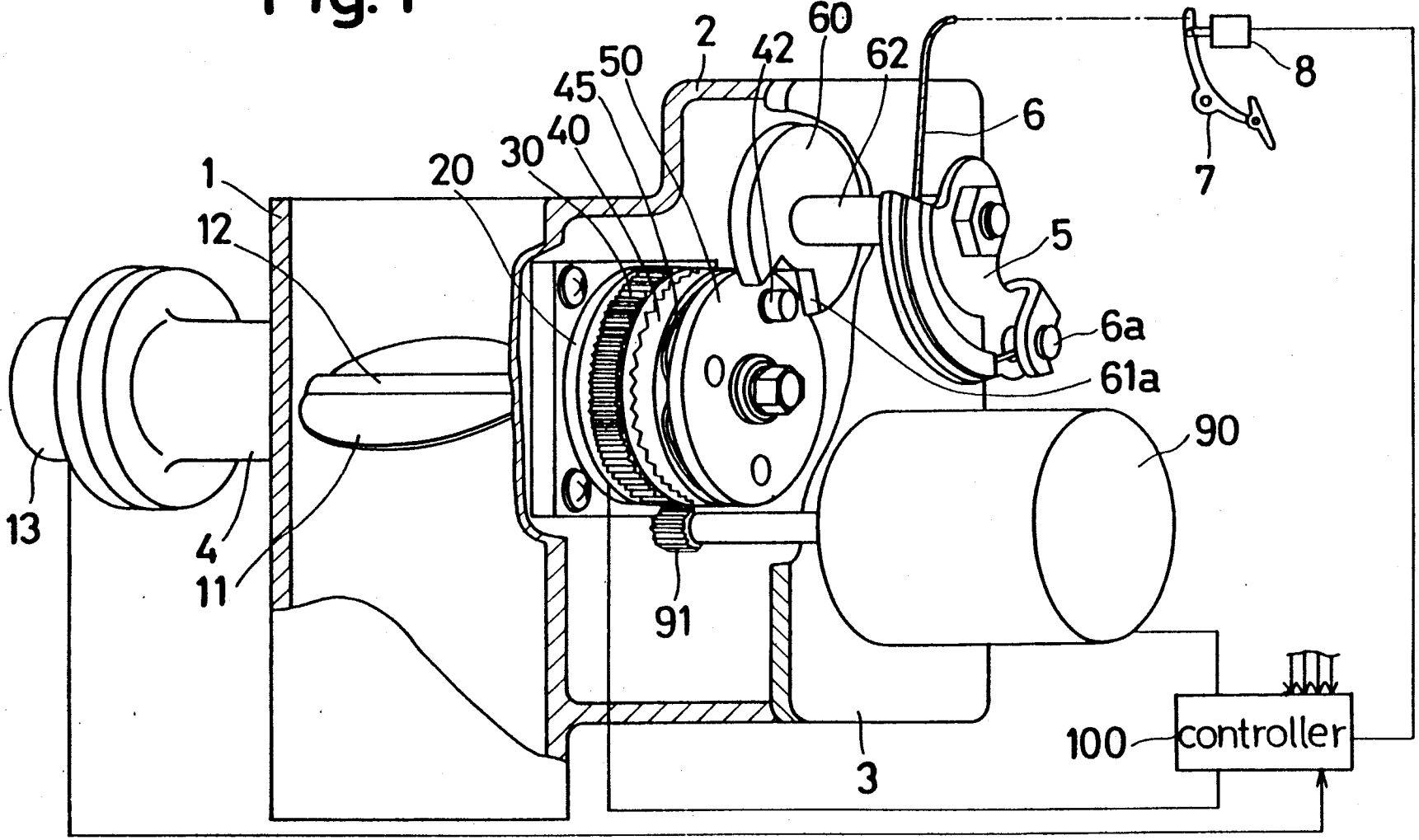
FIG. 1 is a perspective view of an embodiment of a throttle control apparatus in accordance with the present invention.
Figure 2:
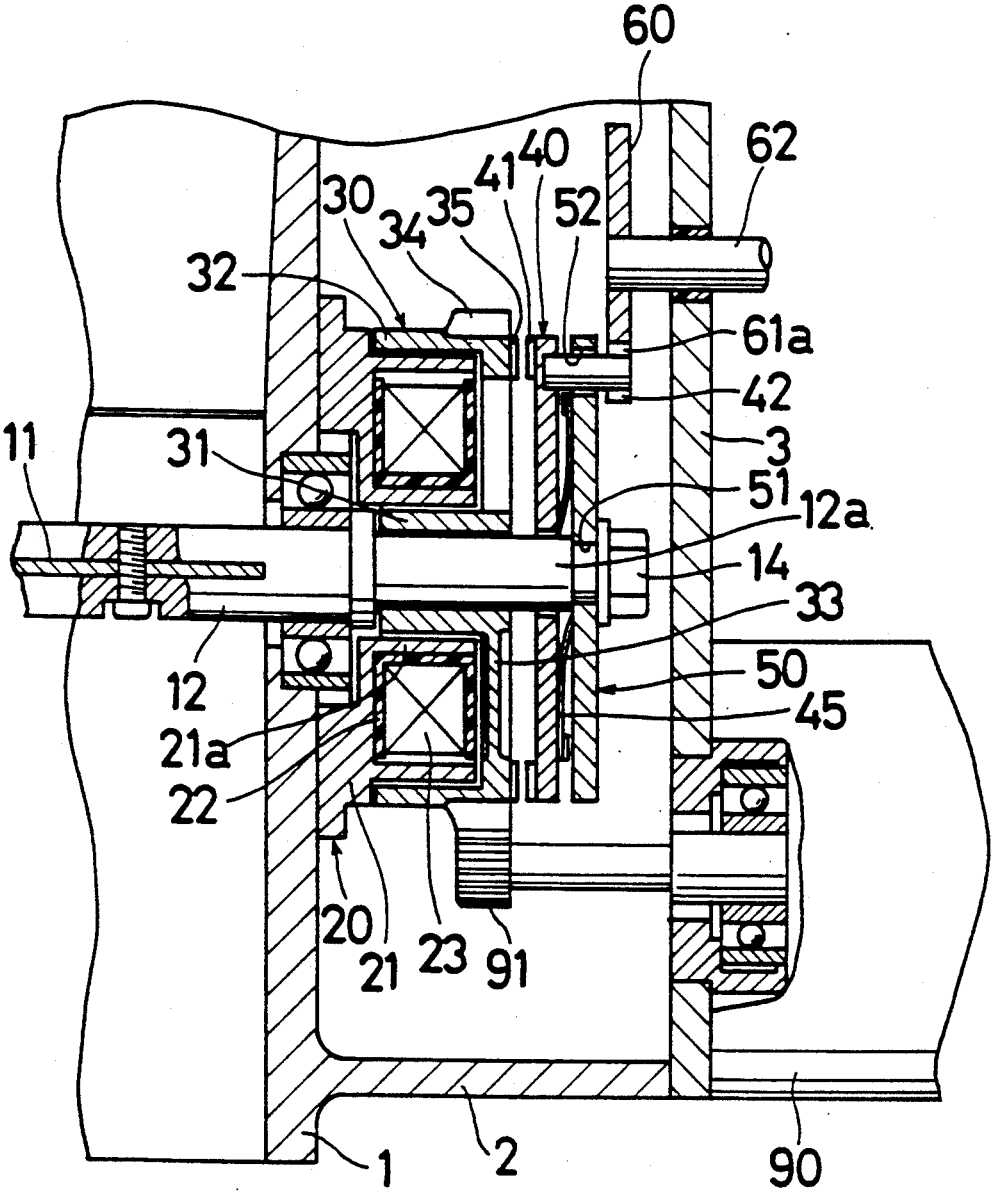
FIG. 2 is a longitudinal sectional view of an embodiment of a throttle control apparatus in accordance with the present invention.
Figure 3:
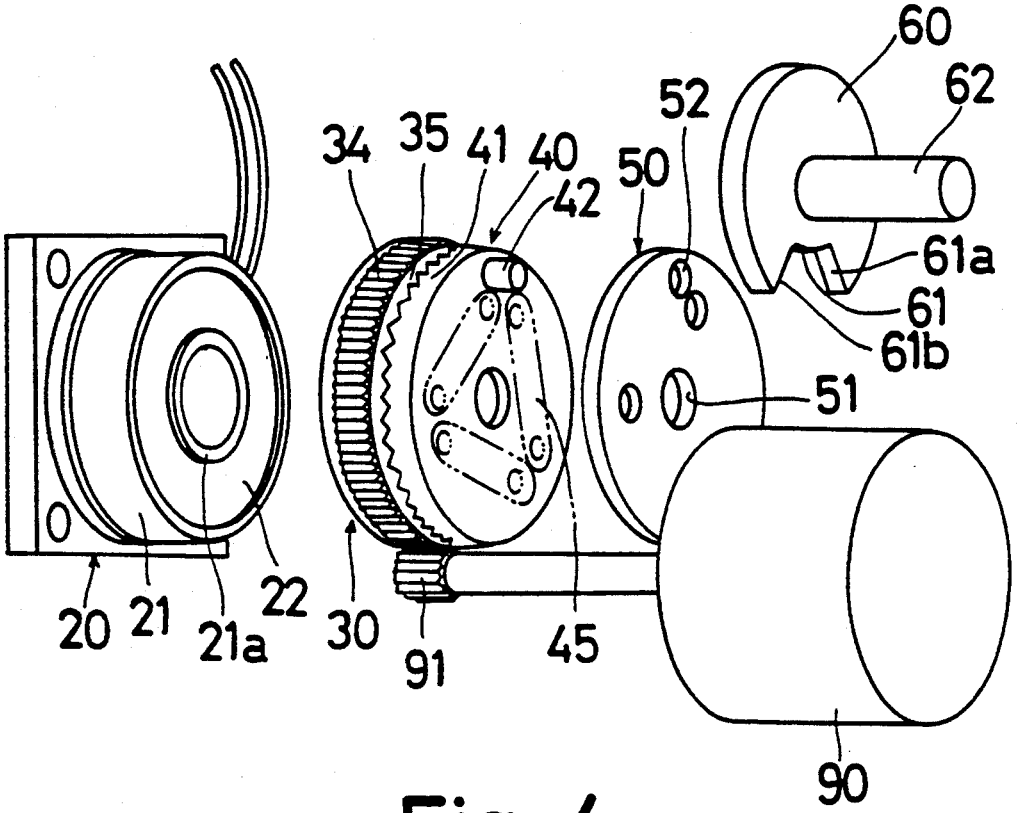
FIG. 3 is an exploded perspective view of an embodiment of a throttle control apparatus in accordance with the present invention.

Referring to FIG. 1 to FIG. 3, a throttle valve 11 is disposed in a housing 1 which forms an intake air passage of an internal combustion engine. The throttle valve 11 is fixed to a throttle shaft 12 and the throttle shaft 12 is supported on the housing 1 so as to be able to rotate. One end of the throttle shaft 12 extends from a side of the housing 1 to the outside. At the side of the housing 1 which locates around an extending portion 12*a*, a case 2 is formed in a body and a cover 3 is united with the case 2. The principal part of parts constituting the throttle control apparatus of this embodiment is received in a space which is defined by the case 2 and the cover 3. On the other hand, at a side of the housing 1 which locates opposite to the case 2 and on which the other end of the throttle shaft 12 is supported, a cylindrical support 4 is formed on the housing 1 in a body. In the support 4, a return spring (not shown) is received and thereby the throttle shaft 12 is urged by the return spring so as to fully close the throttle valve 11.

At the other end of the throttle shaft 12, a throttle sensor 13 is connected therewith. Since this throttle sensor 13 transforms rotational displacements into electric signals and the structure is well known, the explanation of the structure is omitted. This throttle sensor 13 supplies, for example, an idle-switch signal showing the fully closed position of the throttle valve 11 and a throttle valve opening amount signal corresponding to the amount of the throttle valve 11 opening to a controller 100 as outputs.

An electromagnetic coil 20 is fixed to the side of the housing 1 so as to surround a base portion of the extending portion 12*a* of the throttle shaft 12. The electromagnetic coil 20 is provided with a yoke 21 which is made of a magnetic substance and a bobbin 22 which is made of resin as shown in FIG. 2 and FIG. 3. The yoke 21 is provided with a cylindrical portion 21*a* at its center. Around this cylindrical portion 21*a*, a circular portion is formed on the yoke 21 and the bobbin 22 and a coil 23 are disposed in the circular portion. A bottom portion of the yoke 21 is fixed to the side of the housing 1 and the extending portion 12*a* of the throttle shaft 12 penetrates into the cylindrical portion 21*a*.

Figure 4:
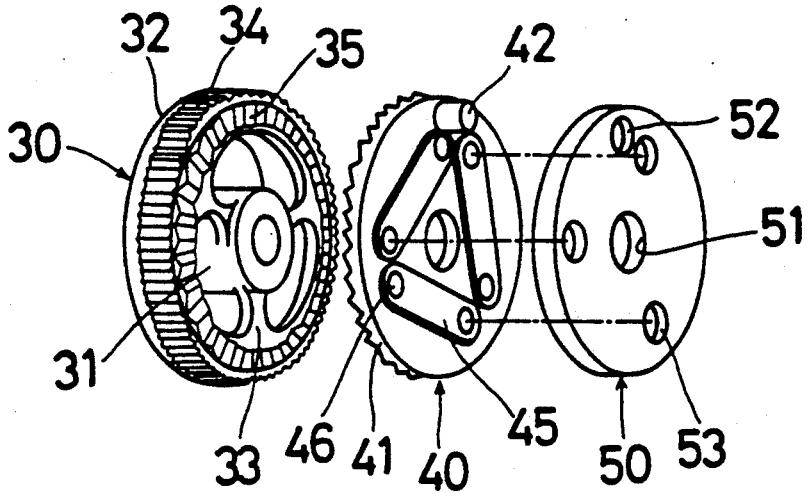
FIG. 4 is an exploded perspective view of an electromagnetic clutch mechanism of an embodiment of a throttle control apparatus in accordance with the present invention.

Furthermore, a rotor 30 which is made of a magnetic substance is supported on the extending portion 12*a* of the throttle shaft 12 so as to be able to rotate. The rotor 30 is disposed in a prescribed position which is opposite to the yoke 21 and is held so as not to be able to move in the direction of an axis of the throttle shaft 12. As shown in FIG. 2 and FIG. 4, the rotor 30 is made of a sintered metal using mainly iron and has a shape which a cylindrical portion 32 is connected with an axial portion 31 supported on the throttle shaft 12 via arm portions 33. The axial portion 31 of the rotor 30 is fitted into the cylindrical portion 21*a* of the yoke 21 with a predetermined gap so as to overlap in the axial direction and the cylindrical portion 32 of the rotor 30 surrounds the outer side of the yoke 21. Thereby, a magnetic loss which generates in gaps between the yoke 21 and the rotor 30 is restrained and a predetermined magnetic permeance is maintained.

At an outer circumferential side of the cylindrical portion 32 of the rotor 30, outer teeth 34 are formed in a body. Furthermore, at a flat portion adjacent to the outer tooth 34, as shown in FIG. 3 and FIG. 4, first nail portions 35 which have triangular sectional shape are continuously arranged on the whole circumference so as to radially extend and are wavily formed thereon.

Furthermore, a clutch plate 40 which has a disk-shaped is supported on the throttle shaft 12 so as to confront with the rotor 30. The clutch plate 40 corresponds to a movable member of the present invention and is able to move in the axial direction. The clutch plate 40 is made of a magnetic substance and is provided with second nail portions 41 which have a same triangular sectional shape as the first nail portions 35 and which are formed on the whole circumference of an its own flat portion opposite to the first nail portions 35 so as to radially extend like the first nail portions 35. This second nail portions 41 can be form by machining or electrospark machining and can be form by press too. In this embodiment, the second nail portions 41 are formed into the sectional shape shown in FIG. 5 by press. Namely, an one press metal mold (not shown) is provided with teeth which have a triangular sectional shape in order to form engaging portions of the second nail portions 41 and another press metal mold (not shown) is provided with teeth which have a trapezoid-sectional shape, and thereby the second nail portions 41 shown in FIG. 5 are formed with high accuracy.

Now, an angle of inclination, namely a meshing gears angle $\theta$ of the nail portions 35, 41 (hereinafter, the nail portions 41 only will be represented) is determined in accordance with atraction-hold condition between the rotor 30 and the clutch plate 40 as follows. At first, as to a friction coefficient $\mu$ of the nail portions 41, conditions of a friction coefficient ($\mu_1$) of hold side of the clutch and a friction coefficient ($\mu_2$) of release side of the clutch are obtained as follows.

Figure 5:
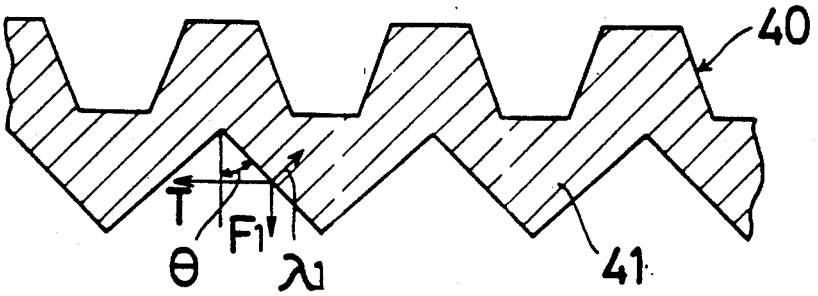
FIG. 5 is a circumferential sectional view of an clutch plate of an embodiment of a throttle control apparatus in accordance with the present invention.

As shown in FIG. 5, a vertical load of the hold side of the clutch with regard to the nail portions 41 is a difference between an atraction force and a spring load of a sheet spring 45 and is shown by a mark $F_1$(kgf). A horizontal load is shown by a mark T(kgf) and a surface pressure is shown by a mark $\lambda_1$(kgf). Thereupon, a following formula (3) is obtained by following formulas (1) and (2).

$$\lambda_1 = T\cdot\cos\theta + F_1\cdot\sin\theta \quad (1)$$

$$0 \geqq T\cdot\sin\theta - F_1\cdot\cos\theta - \mu_1\cdot\lambda_1 \quad (2)$$

$$\mu_1 \geqq (T\cdot\sin\theta - F_1\cdot\cos\theta)/(T\cdot\cos\theta + F_1\cdot\sin\theta) \quad (3)$$

Next, about the release side of the clutch, a following formula (6) is obtained by following formulas (4) and (5). Now, a vertical load is shown by a mark $F_2$(kgf) and a surface pressure is shown by a mark $\lambda_2$(kgf).

$$\lambda_2 = T\cdot\cos\theta - F_2\cdot\sin\theta \quad (4)$$

$$0 < T\cdot\sin\theta + F_2\cdot\cos\theta - \mu_2\cdot\lambda_2 \quad (5)$$

$$\mu_2 < (T\cdot\sin\theta + F_2\cdot\cos\theta)/(T\cdot\cos\theta - F_2\cdot\sin\theta) \quad (6)$$

Figure 6:
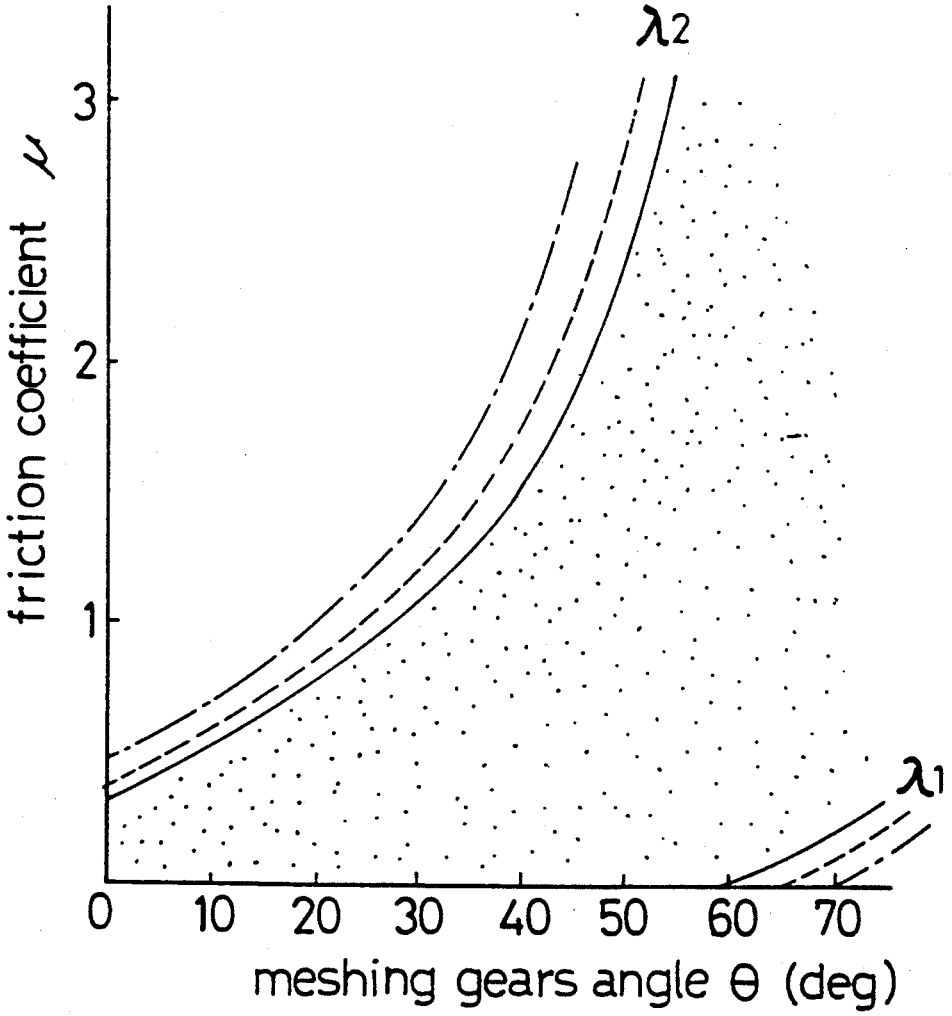
FIG. 6 is a special characteristic view which determines an angle of inclination of nails formed on a rotor and a clutch plate of an embodiment of a throttle control apparatus in accordance with the present invention.

In the relationships between the friction coefficient $\mu$ ($\mu_1$,$\mu_2$) and the meshing gears angle $\theta$ (deg) which are obtained as mentioned above, for example, the special characteristics are shown in FIG. 6 when the vertical load $F_1$ is 1.55 kgf and the vertical load $F_2$ is 0.81 kgf and a range which is shown by a sketch is an usable range. Now, in FIG. 6, special characteristics are shown by a solid line when the horizontal load T is 2.64 kgf, special characteristics are shown by a broken line when the horizontal load T is 2.20 kgf and special characteristics are shown by a chain line when the horizontal load T is 1.76 kgf. Thus, it is able to obtain an optimum value of the meshing gears angle $\theta$ (deg) and a value in 20~70(deg) is advisable in view of an intermittence performance of the clutch. Furthermore, when the number of turns of the coil and an electric current and so on are increased, it is able to move $\lambda_1$ toward right side in FIG. 6 and thereby it is able to increase a hold torque. As a result, it is able to obtain a disirable clutch performance.

Referring to FIG. 3, a pin 42 is fixed to a face of the clutch plate 40 which locates opposite the face having the second nail portions 41. Furthermore, at this face of the clutch plate 40, one ends of the sheet springs 45 which are shown by a chain line in FIG. 3 and which are shown by a solid line in FIG. 4 are fixed thereto by pins 46. On the other hand, the other ends of the sheet springs 45 are fixed to a plate holder 50 mentioned later by pins (not shown). Accordingly, the clutch plate 40 is connected with the plate holder 50 via the sheet springs 45. Now, if one of the pins 46 for fixing the sheet springs 45 is extended and is used as the pin 42 in common, it is able to reduce the number of the parts. Now, the sheet springs correspond to the connection member of the present invention.

At a top end portion of the extending portion 12*a* of the throttle shaft 12, the plate holder 50 is fixed thereto. Now, the plate holder 50 corresponds to the supporting member of the present invention. The plate holder 50 is provided with an oval hole 51 which is formed at its center. On the other hand, the top end portion of the extending portion 12*a* of the throttle shaft 12 is formed so as to be same sectional shape as the hole 51 and is fitted into the hole 51. Thereby, the plate holder 50 is restrained from rotating with regard to the throttle shaft 12. The top end portion of the extending portion 12*a* has a same length as thickness of the plate holder 50. A bolt (or a nut) 14 is screwed down the top end surface of the extending portion 12*a* and thereby the plate holder 50 is nipped between the bolt (or the nut) 14 and a step portion which is formed at a base portion of the top end portion of the extending portion 12*a*. Now, the hole 51 and the top end portion of the extending portion 12*a* may have, for example, a semicircular sectional shape and can be formed various shapes which restrain the plate holder 51 for rotating with regard to the throttle shaft 12.

The plate holder 50 is further provided with a hole 52 and holes 53. The hole 52 is formed at outer edge portion of the plate holder 50 and the pin 42 is penetrated into the hole 52. The holes 53 are formed for caulking the sheet springs 45. Thus, when the plate holder 50 is fixed on the throttle shaft 12, a top end of the pin 42 is projected from the hole 52 of the plate holder 50 as shown in FIG. 1 and FIG. 2.

Furthermore, an operation plate 60 is disposed around the pin 42 which is fixed to the clutch plate 40 so as to be opposite to the plate holder 50 at its outer edge portion. An accelerator shaft 62 is fixed to a center portion of the operation plate 60 and is supported by the cover 3 in nearly parallel with the throttle shaft 12 so as to be able to rotate. Now, the operation plate 60 is restrained from moving in the axial direction. The operation plate 60 is provided with a notch 61 which is formed at its outer edge portion so as to overlap with the pin 42. The operation plate 60 is arranged so that at least one of radial surfaces 61*a* and 61*b* can contact with side of the pin 42 in response to the rotation of the operation plate 60 in the nonexciting condition of the electromagnetic coil 20.

Other end of the accelerator shaft 62 is connected with an accelerator plate 5 shown in FIG. 1 by a bolt or a nut and a cable end 6*a* which is formed on one end of an accelerator cable 6 is engaged with an outer edge portion of the accelerator plate 5. The other end of the accelerator cable 6 is connected with an accelerator 7 and thereby an accelerator operation mechanism by which the operation plate 60 is rotated around an axial center of the accelerator shaft 62 in response to the operation of the accelerator 7 is constituted. A well-known accelerator sensor 8 is installed on the accelerator 7. Thereby, a depression amount namly, a operation amount of the accelerator 7 is detected by the accelerator sensor 8 and an electric signal corresponding the operation amount is supplied to the controller 100. Now, the accelerator sensor 8 may be arranged so as to link to the accelerator shaft 62.

Furthermore, a motor 90 as a driving source of the present invention is fixed to the cover 3 and a rotation shaft of the motor 90 is supported in parallel with the throttle shaft 12 so as to be able to rotate. At a top end of the rotation shaft of the motor 90, a pinion gear 91 is fixed thereto and is engaged with the outer teeth 34 of the rotor 30. In this embodiment, a stepping motor is employed as the motor 90 and is driven and controlled by the controller 100. Now, it is able to apply a motor of other-type, for example, such as DC motor as the motor 90.

When the motor 90 is driven and the pinion gear 91 is rotated, the rotor 30 having the outer teeth 34 which are engaged with the pinion gear 91 is rotated around the throttle shaft 12. In this situation, if the electromagnetic coil 20 is in its nonexciting condition, the clutch plate 40 is separated from the rotor 30 by the urging force of the sheet springs 45 and is located in the adjacent position to the plate holder 50. Namly, the clutch plate 40, the plate holder 50 and the throttle valve 11 can be freely rotated by the throttle shaft 12 regardless of the condition of the rotor 30. In this situation, the pin 42 which is fixed to the clutch plate 40 is located between both surfaces 61*a* and 61*b* of the notch 61 of the operation plate 60.

When the electromagnetic coil 20 is excited, a closed magnetic circuit is formed by the yoke 21, the rotor 30 and the clutch plate 40. Thereby, the clutch plate 40 is attracted toward the rotor 30 against to the urging force of the sheet springs 45 by an electromagnetic force and the first nail portions 35 of the rotor 30 and the second nail portions 41 of the clutch plate 40 are engaged with each other. Accordingly, the rotor 30 and the clutch plate 40 become an engaging condition and become a condition which are able to rotate in a body. Thereby, driving controlled variable of the motor 90 is transmitted from the pinion gear 91 to the rotor 30 via the outer teeth 34 and next is transmitted to the clutch plate 40 via first nail portions 35 and the second nail portions 41. Furthermore, the driving controlled variable is transmitted from the clutch plate 40 to the plate holder 50 via the sheet springs 45 and therefore is transmitted to the throttle shaft 12 which rotates with the plate holder 50 in a body. As a result, the amount of the throttle valve 11 opening is controlled in response to the above driving controlled variable. In this situation, since the pin 42 moves with the clutch plate 40 toward the rotor 30 and does not locate between both surfaces 61*a* and 61*b* of the notch 61 of the operation plate 60, the operation plate 60 is rotated regardless of the condition of the pin 42.

When the electric current being supplied to the electromagnetic coil 20 is interrupted under the opening condition of the throttle valve 11, the engagement between the first nail portions 35 of the rotor 30 and the second nail portions 41 of the clutch plate 40 is released and then the throttle valve 11 is fully closed by the urging force of the return spring (not shown) which is disposed in the support 4.

As mentioned above, an electromagnetic clutch mechanism is constituted by the electromagnetic coil 20, the rotor 30 and the clutch plate 40. Furthermore, a dog clutch is constituted by the rotor 30 and the clutch plate 40 and therefore a driving force of the motor 90 is transmitted to the throttle shaft 12 immediately. Thereby, a correction amount which is required after the connection of the clutch is little and it is able to obtain a good response performance. Now, since the connecting portion between the rotor 30 and the clutch plate 40 becomes a line contact or a surface contact between the first nail portions 35 and the second nail portions 41, the surface pressure of the connecting portion is low and therefore this clutch is excellent in durability.

Furthermore, since the first nail portions 35 and the second nail portions 41 are formed near the outer teeth 34 which are formed on the outer circumferential edge portion of the cylindrical portion 32 of the rotor 30 and large force is not operated to the arm portions 33 which connect the axial portion 31 and the cylindrical portion 32, it is able to slendery form the arm portions 33 and it is able to enlarge openings which are formed between each arm portion 33 as shown in FIG. 4. Accordingly, it is able to constitute a good magnetic circuit with regard to the electromagnetic coil 20 and it is able to effectively use the electromagnetic force as a coupling force.

Figure 7:
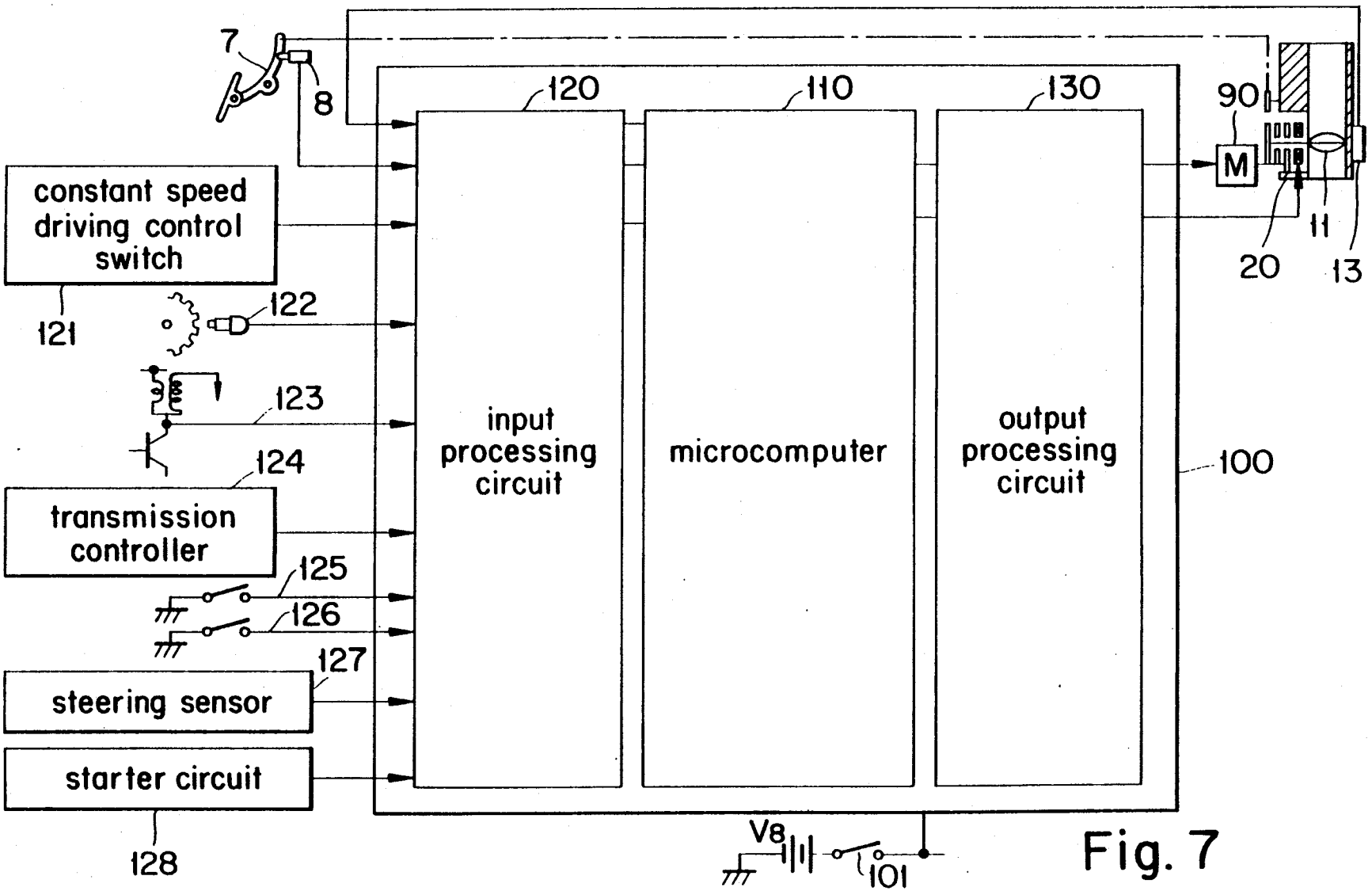
FIG. 7 is a schematic illustration of a controller and an input and output device of an embodiment of a throttle control apparatus in accordance with the present invention; and, FIG. 8 is a flow-chart which shows a general operation of an embodiment of a throttle control apparatus in accordance with the present invention.

The controller 100 is a control circuit including microcomputer and functions as a driving control means of the present invention. Namely, the controller 100 is installed on the vehicle and is supplied detecting signals of various sensors as shown in FIG. 7. Thereby, various controls including the driving controls of the electromagnetic coil 20 and the motor 90 are performed by the controller 100. In this embodiment, the various controls such as a constant speed driving control, an acceleration slip control and so on are performed besides an ordinary control responding to the operation of the accelerator by the controller 100.

Referring to FIG. 7, the controller 100 is provided with a microcomputer 110, an input processing circuit 120 and an output processing circuit 130. The input processing circuit 120 and the output circuit 130 are connected with the microcomputer 110 and the motor 90 and the electromagnetic coil 20 are connected with the output processing circuit 130. Furthermore, the controller 100 is connected with an electric source $V_B$ via an ignition switch 101. Now, it is able to apply a transistor or a relay which turns on electricity when the ignition switch 101 is ON or other switching elements as an electric source opening-closing means of the controller 100.

Furthermore, the accelerator sensor 8 is connected with the input processing circuit 120. A signal which is generated by the accelerator sensor 8 in response to the depressing amount of the accelerator 7 is supplied to the output processing circuit 120 with an output signal of the throttle sensor 13. The electromagnetic coil 20 is controlled by the controller 100 so as to excite and nonexcite in response to the driving condition of the vehicle and furthermore the driving of the motor 90 is controlled by the controller 100 so as to be able to obtain the amount of the throttle valve 12 opening which is determined in response to depressing amount of the accelerator 7 and various control conditions. A constant speed driving control switch 121 which is constituted by plural groups of switches (not shown) is connected with the input processing circuit 120.

A wheel speed sensor 122 is used for the constant speed driving control, the acceleration slip control and so on and an electromagnetic pickup sensor or hole sensor and son are applied as the wheel speed sensor 122. Now, one wheel speed sensor 122 is shown in FIG. 7, but the wheel speed sensor 122 is installed on each wheel according to demand. Furthermore, an ignition circuit unit, commonly called an igniter 123 is connected with the controller 100. Thereby, an ignition signal is supplied from the igniter 123 to the controller 100 and the number of rotations of the combustion engine is detected. A transmission controller 124 is a control device for controlling an automatic transmission and a variable speed signal and a timing signal which are generated in the transmission controller 124 are supplied to the controller 100.

Furthermore, a mode changeover switch 125, an acceleration prohibition switch 126 and a steering sensor 127 are connected with the input processing circuit 120. The mode changeover switch 125 selects one of maps which predetermined about relationships between the depressing amount of the accelerator 7 and the amount of the throttle valve 12 opening in response to various driving modes and determines the amount of the throttle valve 12 opening in response to the selected driving mode. Now, the maps are memorized in the microcomputer 110. Thereby, for example, a power mode or an economy mode, in other words, a highway driving mode or a city area driving mode is selectively determined as the driving mode. The acceleration slip control prohibition switch 126 supplies a signal for prohibiting the acceleration slip control to the microcomputer 110 when a driver does not require the acceleration slip control and operates that. The steering sensor 127 judges whether a steering (not shown) is operated or not for example when the acceleration slip control is performed and determines a target slip rate in response to the result of the judgement. Furthermore, a starter circuit 128 which controls the driving of a starting motor (not shown) is connected with the input processing circuit 120. Thereby, the starting motor is not driven until the normal functioning of the throttle control apparatus is confirmed by the practical open-close operation of the throttle valve 12 when an initial check is performed whether the throttle control apparatus functions normally or not. Therefore, it is able to avoid the excess rotation of the combustion engine when the initial check of the throttle control apparatus is performed.

Figure 8:
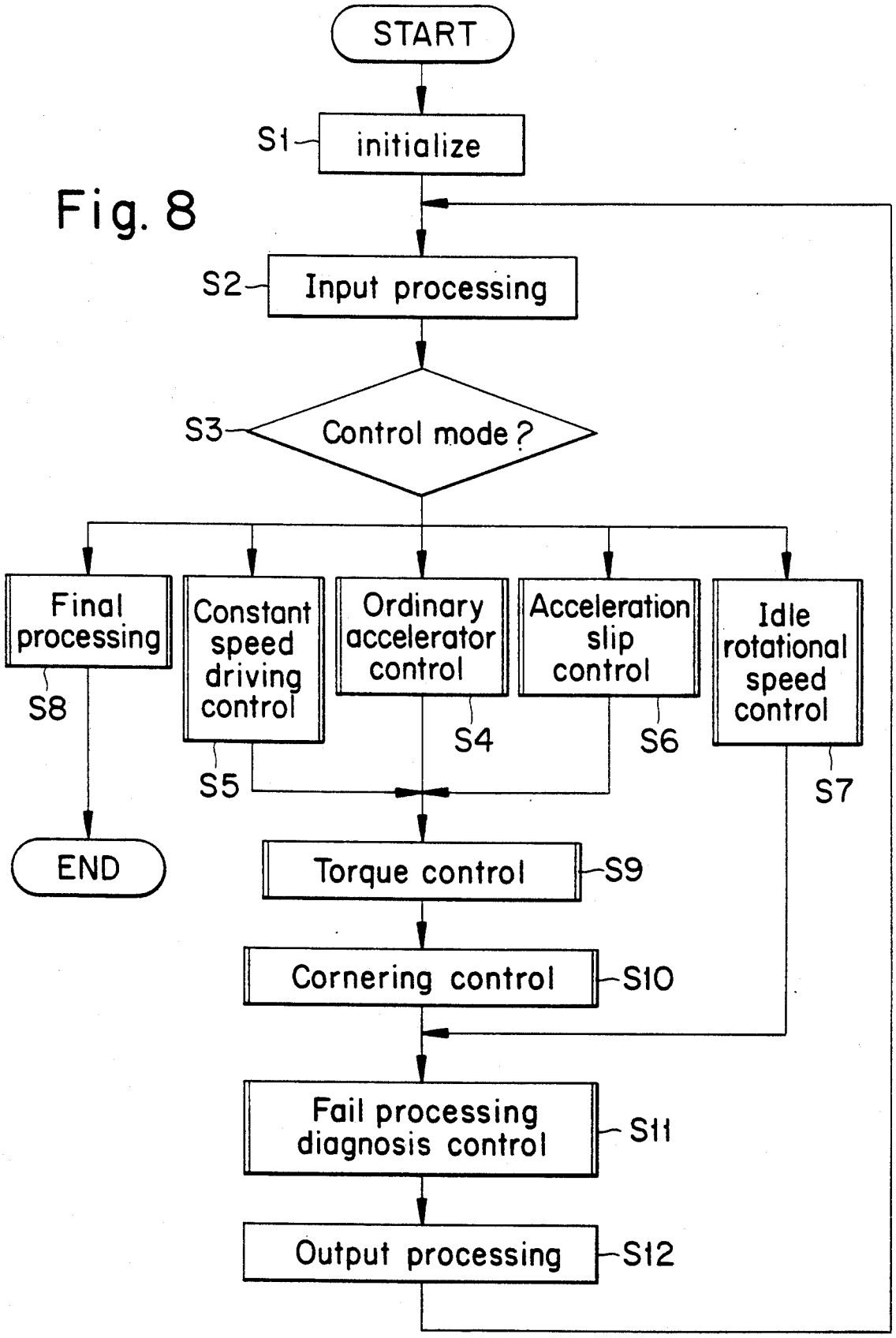

The above-described embodiment of the throttle control apparatus operates as follows. FIG. 8 is a flowchart which shows a general operation of this embodiment of a throttle control apparatus. In the controller 100, at first, an initialize is performed in step S1 and next the above-described various input signals which are supplied to the input processing circuit 120 are processed in step S2. Next, step 3 is performed and a control mode is selected in response to the input signals. Namely, one of steps S4–S8 is selected.

When the controls of the steps S4–S6 are performed (now, the ordinary accelerator control is performed in step S4, the constant speed driving control is performed in step S5 and the acceleration slip control is performed in step S6), a torque control and a cornering control are performed in step S9 and step S10, respectively. In the torque control, the throttle control is performed so as to reduce a shock which is generated in a variable speed operation. On the other hand, in the cornering control, the throttle control is performed in response to a steering angle of the steering (not shown). Now, since both controls are not directly related to this embodiment, explanation are omitted. Step S4 performs an idle rotational speed control and controls the throttle control apparatus so as to maintain the idle rotational speed even though the condition of the internal combustion engine changes. Step S8 performs an after-process after the ignition switch 101 became OFF. After the steps S7 and S10 were performed, respectively, a self-diagnosis is performed in step S11 by a diagnosis means and furthermore a fail-process is performed in step S11. Next, an output-process is performed in step S12 and the electromagnetic coil 20 and the motor 90 are driven via the output processing circuit 130. Thereafter, the above-described routine is repeated with a predetermined period.

Next, the operation of the ordinary accelerator control mode in the above general operation is explained. When the accelerator 7 is not operated, namely when the throttle valve 11 is fully closed, the clutch plate 40 is located at the side of the plate holder 50 by the urging force of the sheet springs 45 and is separated from the rotor 30.

When the electromagnetic coil 20 is applied an electric current and the yoke 21 and the rotor 30 are excited, the clutch plate 40 is attracted toward the rotor 30 and the first nail portions 35 and the second nail portions 41 are engaged with each other. A condition which is able to transmit the driving force of the motor 90 to the throttle shaft 12 is obtained. In this situation, since the pin 42 is moved with the clutch plate 40 toward the rotor 30, the notch 61 of the operation plate 60 is not engaged with the pin 42. Hereafter, except for abnormal conditions mentioned later, the throttle shaft 12 is rotated by the motor 90 and thereby the amount of the throttle valve 11 opening is controlled by the control of the motor 90 in the controller 100.

In the ordinary accelerator control mode, namely, when the depressing operation of the accelerator 7 is performed, an output signal of the accelerator sensor 8 is supplied to the controller 100 in response to the operation amount and a target amount of the throttle valve opening is determined in the controller 100. Then, when the motor 90 is driven and the throttle shaft 12 is rotated, an output signal of the throttle sensor 13 is supplied to the controller 100 in response to the rotational angle of the throttle shaft 12 and the driving of the motor 90 is controlled by the controller 100 so as to nearly equalize the amount of the throttle valve 11 opening to the above target amount of the throttle valve opening. Thereby, the throttle control corresponding to the operation amount of the accelerator 7 is performed and the generating power of the engine which corresponds to the amount of the throttle valve 11 opening is obtained.

As mentioned above, the accelerator 7 is not mechanically connected with the throttole valve 11 and thereby it is able to obtain a smooth start and a smooth driving of the vehicle. Now, when the operation of the accelerator 7 is released, the throttle valve 11 is fully closed by the driving force of the motor 90 and the urging force of the return spring (not shown) which is disposed in the support 4.

In the above ordinary accelerator control mode, when the abnormal conditions including an abnormal operation of the throttle valve 11 are detected, the electric current which is turned on the electromagnetic coil 20 is interrupted. Thereby, the clutch plate 40 is separated from the rotor 30 by the urging force of the sheet springs 45 and the throttle valve 11 is returned to its initial position by the return spring which is disposed in the support 4. Furthermore, the driving of the rotor 30 by the motor 90 is stopped too. In this situation, since the clutch plate 40 is moved toward the plate holder 50, the pin 42 is located between both surfaces 61*a* and 61*b* of the notch 61 of the operation plate 60. Accordingly, when the accelerator 7 is depressed more than a predetermined amount, the operation plate 60 is rotated and the surface 61*a* of the notch 61 is contacted with the pin 42. Therefore, hereafter it is able to directly transmit the operation force of the accelerator 7 by driver to the throttle shaft 12.

Next, the operation of the acceleration slip control mode is explained. When a slip of driving wheels is detected by the controller 100 at a starting time or an accelerating time in response to the output siganl of the wheel speed sensor 122 shown in FIG. 7, the control mode is changed from the above described ordinary accelerator control mode to the accelerator slip control and the amount of the throttle valve 11 opening is controlled as follows.

Namely, in the controller 100, a slip ratio which can obtain a sufficient tractive force and a sufficient side reaction is calculated and furthermore a target amount of the throttle valve opening is calculated in order to maintain this slip ratio. Then, the driving of the motor 90 is controlled by the controller 100 so that the throttle valve 11 maintains the target amount of the throttle valve opening. When the slip rate becomes less than a predetermined value and the target amount of the throttle valve opening becomes more than the amount of the throttle valve opening determined in the ordinary accelerator control mode, the acceleration slip control mode ends and the control mode returns to the ordinary accelerator control mode.

In this situation, since the operation plate 60 and the pin 42 are engaged with each other in normal condition as mentioned above, even though the accelerator 7 is depressed more than the predetermined amount, a mechanically intervention is not generated in the control of the amount of the throttle valve opening by the motor 90. Accordingly, for example, when an acceleration slip is generated on road surface with low friction coefficient and the control mode changed to the acceleration slip control mode, even though the driver depresses the accelerator 7 large, it is able to fully close the throttle valve 11 by the motor 90. Therefore, it is able to perform the expected acceleration slip control and it is able to maintain the stable driving.

Now, the operation of the constant speed driving control mode is briefly explained. In the constant speed driving control mode, a target amount of the throttle valve opening is determined in response to a difference between the vehicle's speed which was detected by the wheel speed sensor 122 and a vehicle's speed which was set by a set switch (not shown) of the constant speed driving control and the driving of the motor 90 is controlled by the controller 100 so that the throttle valve 11 maintains this target amount of the throttle valve opening. When the accelerator 7 is depressed for outrunning and so on during the constant speed driving and the amount of the throttle valve opening corresponding to the operation amount in the ordinary accelerator control mode exceeds the target amount of the throttle valve opening which the constant speed driving control mode was set, the constant speed driving control mode is changed to an overlaid mode and this target amount of the throttle valve opening is replaced with the amount of the throttle valve opening which is determined in the ordinary accelerator control mode.

As described above, according to the present invention, since the electromagnetic clutch mechanism is provided with the dog clutch, the driving force of the driving source is immediately transmitted to the throttle shaft when the electromagnetic clutch mechanism is operated. Thereby, a correction amount which is required after the connection of the clutch is reduced and it is abel to obtain a good response performance. Furthermore, since the connecting portion which transmits the driving force becomes a line contact or a surface contact, the surface pressure of the connecting portion is low and therefore it is able to improve the durability.

Furthermore, according to the present invention, in the case of the throttle apparatus which first nail portion and the second nail portions are formed on the rotor and the movable member, respectively, even though the outer circumferential edge portion and the axial center of the rotor are connected with each other via at least one arm portion and an opening is formed in the arm portion or between each arm portion, since the both nail portions are formed near the outer teeth which are formed on the outer circumferential edge portion of the cylindrical portion of the rotor and large force is not operated to the arm portion, it is able to slenderly form the arm portions and therefore it is able to reduce the weight of the throttle control apparatus. Furthermore, since it is able to englarge the openings, it is able to constitute a good magnetic circuit with regard to the electromagnetic coil and it is able to effectively use the electromagnetic force as a coupling force. Thereby, it is able to miniaturize the electromagnetic coil. Furthermore, since the driving force is transmitted via the outer teeth which are formed on the outer circumferential edge portion of the rotor connected with the driving source, it is able to enlarge the reduction ratio and therefore other reduction gears are not required.

Thereby, it is able to reduce the number of the parts and it is able to miniaturize the throttle control apparatus.

Furthermore, according to the present invention, in the case of the throttle control apparatus which the movable member is formed by press, since it is able to easily form the second nail portions which it is difficult to manufacture, it is able to mass-produce.

Furthermore, in the case of the throttle control apparatus which the rotor is provided with the cylindrical portion, since the electromagnetic coil is surrounded with cylindrical portion, it is able to maintain an expected magnetic permeance. Accordingly, prior magnetic cover sheet is not required and it is able to reduce the number of the parts.

The principles, preferred embodiment of the present invention have been described in the foregoing application. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in appended claims.

What is claimed:

1. A throttle control apparatus comprising;

an accelerator operation mechanism, a driving source generating driving force in response to at least an operation amount of the accelerator operation mechanism, a throttle shaft fixing a throttle valve of an internal combustion engine thereto and supported on a housing so as to be able to rotate, an electromagnetic clutch mechanism being intermittent a connection between the throttle shaft and the driving source and having a dog clutch which transmits the driving force of the driving source to the throttle shaft and a driving control means for controlling the electromagnetic clutch mechanism and the driving source and opening and closing the throttle valve.

2. A throttle control apparatus comprising;

an accelerator operation mechanism, a driving source generating driving force in response to at least an operational amount of the accelerator operation mechanism, a throttle shaft fixing a throttle valve of an internal combustion engine thereto and supported on a housing so as to be able to rotate and having at least an one end portion which extends from the housing, a supporting member fixed to an extending portion of the throttle shaft, a rotor supported at a prescribed place on the throttle shaft between the supporting member and the throttle valve so as to be able to rotate and so as not to be able to move in the direction of an axis of the throttle shaft and having outer teeth which are formed on the whole circumference of its own outer circumferential end portion and first nail portions which are formed on an its own flat portion adjacent to the outer teeth so as to radially extend and so as to be continuously arranged on the whole circumference and connected with the driving source so as to be rotated by the driving force of the driving source, a movable member made of a magnetic substance and supported on the throttle shaft so as to be movable in the direction of the axis of the throttle shaft between the rotor and the supporting member and having second nail portions which are formed on the whole circumference of an its own flat portion opposite to the rotor so as to locate opposite to the first nail portion and so as to have a substantially same shape as the first nail portions in order to constitute a dog clutch with the rotor, a connection member connecting the movable member with the supporting member and urging the movable member toward the supporting member and an electromagnetic coil fixed to an place of the housing opposite to the rotor and attracting the movable member under its own exciting condition so as to connect the movable member with the rotor.

3. A throttle control apparatus as recited in claim 2, wherein the second nail portions of the movable member are formed into a triangular sectional shape which is radially extended and which is continuously arranged on the whole circumference by press, respectively.

4. A throttle control apparatus as recited in claim 2, wherein the rotor is provided with a cylindrical portion and is disposed so as to surround the electromagnetic coil with the cylindrical portion.

* * * * *